US011834852B2

(12) United States Patent
Huber et al.

(10) Patent No.: US 11,834,852 B2
(45) Date of Patent: Dec. 5, 2023

(54) STRIKING TOOL AND METHOD

(71) Applicant: PERI SE, Weissenhorn (DE)

(72) Inventors: Julian Huber, Merklingen (DE); Andrew Read, Voehringen (DE); Florian Sturm, Unterroth (DE)

(73) Assignee: PERI SE, Weissenhorn (DE)

( * ) Notice: Subject to any disclaimer, the term of this patent is extended or adjusted under 35 U.S.C. 154(b) by 0 days.

(21) Appl. No.: 16/988,492

(22) Filed: Aug. 7, 2020

(65) Prior Publication Data

US 2022/0042331 A1 Feb. 10, 2022

(51) Int. Cl.

| | |
|---|---|
| ***E04G 19/00*** | (2006.01) |
| ***E04G 17/14*** | (2006.01) |
| ***E04G 17/06*** | (2006.01) |

(52) U.S. Cl.

CPC ..... *E04G 19/00* (2013.01); *E04G 17/06* (2013.01); *E04G 17/14* (2013.01)

(58) Field of Classification Search

CPC ..... E04G 17/14; E04G 17/16; E04G 19/00; E04G 19/003; E04G 25/02; B60S 9/14; B60S 9/205; B60S 25/02; B60S 9/02; B60S 9/04; B60S 9/06; B66F 7/0641; B66F 3/12; E01D 21/00

USPC ..... 254/84, 85, 10 R, 10 B, 10 C

See application file for complete search history.

(56) References Cited

U.S. PATENT DOCUMENTS

| | | | | | |
|---|---|---|---|---|---|
| 227,016 | A * | 4/1880 | Johnson | B66F 7/0641 | 254/10 R |
| 260,191 | A * | 6/1882 | Gould et al. | B60S 9/14 | 254/421 |
| 621,344 | A * | 3/1899 | Jones | B65G 1/133 | 414/787 |
| 711,098 | A * | 10/1902 | Carr | B66F 7/0641 | 254/10 R |
| 1,080,581 | A * | 12/1913 | Preece | B66F 7/0641 | 254/10 R |
| 1,183,970 | A * | 5/1916 | Gray | B66F 5/04 | 254/91 |
| 1,478,562 | A * | 12/1923 | Fisk | B61D 19/002 | 254/84 |
| 1,605,777 | A * | 11/1926 | Richardson | B61D 19/002 | 254/84 |
| 2,502,285 | A * | 3/1950 | Smith | B60B 29/002 | 254/10 R |

(Continued)

FOREIGN PATENT DOCUMENTS

| | | |
|---|---|---|
| CN | 103255719 | 8/2013 |
| CN | 205775859 | 12/2016 |

(Continued)

OTHER PUBLICATIONS

Translation of FR 1,414,893. (Year: 1965).*

(Continued)

*Primary Examiner* — Michael Safavi

(74) *Attorney, Agent, or Firm* — SLEMAN & LUND LLP

(57) ABSTRACT

A striking tool having a base element and a striking element configured to engage with a formwork panel. The striking tool has a plurality of struts, wherein the base element, the striking element, and the plurality of struts define a parallelogram configuration and an actuation mechanism configured to cause relative motion between the base element and the striking element.

19 Claims, 5 Drawing Sheets

(56) References Cited

U.S. PATENT DOCUMENTS

| | | | | | |
|---|---|---|---|---|---|
| 2,788,193 | A * | 4/1957 | Sanders | B62B 3/0618 | 254/10 R |
| 2,994,443 | A * | 8/1961 | Gordon | B25H 1/0007 | 254/10 R |
| 3,861,634 | A | 1/1975 | Hood | | |
| 4,848,732 | A * | 7/1989 | Rossato | B66F 7/08 | 254/133 R |
| 5,769,396 | A * | 6/1998 | Tischendorf | B62M 3/00 | 254/134 |
| 5,890,695 | A * | 4/1999 | Brewer, III | F16F 15/02 | 248/656 |
| 6,015,131 | A * | 1/2000 | Brewer, III | B66F 7/0641 | 248/656 |
| 6,443,429 | B1 * | 9/2002 | Hawk | B66F 7/08 | 254/10 R |
| 6,605,240 | B2 | 8/2003 | Hambelton | | |
| 6,619,620 | B1 * | 9/2003 | Carter | B66F 7/0625 | 254/10 C |
| 7,021,861 | B2 * | 4/2006 | Basta | B66F 7/08 | 114/44 |
| 8,052,122 | B2 * | 11/2011 | Rossato | B66F 7/08 | 254/2 B |
| 8,448,921 | B2 * | 5/2013 | Hernandez | B66F 5/04 | 254/133 R |
| 2006/0284147 | A1 * | 12/2006 | Matteucci | G01M 1/02 | 254/84 |
| 2007/0152202 | A1 * | 7/2007 | Kinney | B66F 5/04 | 254/84 |
| 2010/0218452 | A1 * | 9/2010 | Wolf | E04G 11/56 | 52/702 |
| 2017/0251817 | A1 * | 9/2017 | Atkinson, Jr. | A47C 19/025 | |

FOREIGN PATENT DOCUMENTS

| | | | | |
|---|---|---|---|---|
| CN | 106400691 | | 2/2017 | |
| CN | 107604829 | | 1/2018 | |
| CN | 208685449 | | 4/2019 | |
| CN | 210086058 | | 2/2020 | |
| CN | 210238297 | | 4/2020 | |
| CN | 210262742 | | 4/2020 | |
| CN | 210396119 | | 4/2020 | |
| CN | 211285295 | | 8/2020 | |
| CN | 111676837 | | 9/2020 | |
| CN | 211446607 | | 9/2020 | |
| CN | 211547412 | | 9/2020 | |
| CN | 111764265 | | 10/2020 | |
| CN | 211689918 | | 10/2020 | |
| CN | 211689942 | | 10/2020 | |
| CN | 112813837 | | 5/2021 | |
| CN | 113089477 | | 7/2021 | |
| CN | 111535196 | B | 8/2021 | |
| DE | 3010483 | A1 * | 10/1981 | |
| DE | 3409452 | A1 | 9/1985 | |
| DE | 19640396 | A1 | 4/1998 | |
| DE | 29908482 | | 7/1999 | |
| DE | 102009005657 | | 7/2010 | |
| DE | 202015002934 | U1 | 6/2015 | |
| DE | 202017004423 | U1 * | 9/2017 | |
| EP | 1724563 | A2 * | 11/2006 | G01M 1/02 |
| EP | 2210979 | A2 * | 7/2010 | E01D 19/10 |
| EP | 2638210 | | 9/2013 | |
| EP | 2990564 | | 3/2016 | |
| EP | 2995749 | A1 | 3/2016 | |
| EP | 3030719 | | 6/2016 | |
| EP | 3177774 | | 6/2017 | |
| EP | 3221519 | | 9/2017 | |
| EP | 3221519 | B1 | 9/2019 | |
| FR | 1292349 | A | 5/1962 | |
| FR | 1414893 | A * | 10/1965 | |
| FR | 2559470 | A1 * | 8/1985 | B66F 3/12 |
| GB | 582027 | A * | 11/1946 | |
| GB | 2436824 | A * | 10/2007 | |
| GB | 2521920 | A * | 7/2015 | |
| JP | S55159069 | A | 12/1980 | |
| KR | 20060009992 | | 2/2006 | |
| KR | 200431156 | | 11/2006 | |
| KR | 20070107250 | | 11/2007 | |
| KR | 20100039080 | A | 4/2010 | |
| KR | 20100085787 | | 7/2010 | |
| KR | 2016088016 | A * | 7/2016 | |
| KR | 200486454 | | 5/2018 | |

OTHER PUBLICATIONS

Peri GmbH, Self-Spanning-Dancefloor, a new formwork concept/structure to form bridge pier caps, Dec. 3, 2020, 18 pages.
"FTF Facade Formwork" published Jun. 2020.
"Rail Climbing System RCS C" published Oct. 2019.

* cited by examiner

STRIKING TOOL AND METHOD

FIELD OF THE INVENTION

The present invention relates to a striking tool for lowering formwork panels when stripping off the formwork especially from a bridgehead or bridge pier head.

BACKGROUND OF THE INVENTION

For concreting parts of buildings their shape is first specified by a formwork covering the surface of the building part. The formwork skin is usually formed by formwork elements in the form of simple formwork panels or so-called frame formwork elements. Wherever formwork is to be supported for the pouring of concrete, adjustments at the top or bottom of many supports have to be made for vertical or horizontal positioning of such panels with or without relative movement in one or more directions. Although reusable formwork support brackets mounted on the structural columns of a building under construction have been used heretofore which involve lowering the formwork a short distance onto fixed brackets so that the framework can be removed intact and re-used for other sections of flooring, there are situations in which removing of the brackets and formwork is problematic. If the formwork panel is initially to be supported by means of support elements, it is difficult to release it after concreting because the formwork is under load and adheres to the concrete after the concrete has set. In order to prevent damage during striking off the panel, i.e. striking the panel, it is known for example from EP 2 210 979 A1 for ceiling panels that lowering devices are integrated into the support devices which allow the formwork elements to be lowered a few centimeters from the surface of the building slab by actuating a striking mechanism of the lowering devices so that the contact pressure on the support elements is eliminated.

For concreting bridgeheads, for example, there are plane formwork panels in use, which can be in a form deviating from a pure plane. Especially in the last process steps of a bridgehead under construction, a formwork is generally in the form of an L, having thus a horizontal and a vertical component. Striking those panel elements by detaching the slab formwork is therefore relatively difficult to accomplish since the panels are restricted in their movement due to their form. Without tools, such as for example hammers, levers or mobile hydraulics, the activation of known lowering devices is usually not possible. Uncontrolled hammer blows when loosening the support elements can lead to functional restrictions and possibly even to early component failure or wear. The process of loosening the support elements before being then completely taken off generally leads to considerable expenditure of personnel and time. In prior art, these formwork panels are therefore often released by the aid of a crane. To this end, a crane chain is fixed to the respective panel and the crane then has to apply a force on the panel to detach it from the concrete surface and to take it away. This on one hand often leads to damages at the concrete surface but also means an enormous danger for the stuff personal on the construction side, especially when the panel is swinging after detachment.

SUMMARY OF THE INVENTION

The present application overcomes the disadvantages of the prior art by providing a striking tool, comprising: a base element; a striking element configured to engage with at least one of a formwork element or a beam; a plurality of struts, wherein the base element, the striking element, and the plurality of struts define a parallelogram configuration; and an actuation mechanism configured to cause relative motion between the base element and the striking element.

In one example, the base element comprises a mounting portion configured to attach the base element to a mounting surface.

In one example, when activating the actuation mechanism the parallelogram configuration defined by the base element, the striking element, and the plurality of struts is maintained.

In one example, the actuation mechanism comprises a threaded spindle configured to cause lateral motion of the striking element relative to the base element.

In one example, the spindle comprises an attachment point configured to receive a screw-wrench or ratchet.

In one example, the striking tool further comprises a first stopper element and a second stopper element each configured to limit movement of the striking element relative to the base element.

In one example, the second stopper element limits the movement beyond a rectangle form of the parallelogram configuration.

In one example, the second stopper element limits the movement of the struts to a maximum angle of 90 degrees or less in the unactuated state.

In one example, the first stopper element and the second stopper element are integrally formed with the striking tool.

In one example, the mounting portion defines a through-hole configured to receive a screw or bolt for attaching the base element to the mounting surface.

In one example, the relative motion comprises simultaneous motion in a horizontal direction and a vertical direction.

In one example, the formwork element comprises a formwork panel.

Another aspect of the disclosure provides a concrete formwork system for a bridge or bridge pier head, the system comprising: at least one of a formwork element or a beam; and at least one striking tool engaged with the at least one of the formwork element or the beam, the at least one striking stool comprising: a base element; a striking element configured to engage with the at least one formwork panel or the beam; a plurality of struts, wherein the base element, the striking element, and the plurality of struts define a parallelogram configuration; and an actuation mechanism configured to cause relative motion between the base element and the striking element.

In one example, the at least one formwork element or beam has a longitudinal axis that is substantially perpendicular to a bottom surface of the base element when the panel is engaged with the striking element of the striking tool.

In one example, the at least one formwork element or beam further comprises an additional formwork panel such that the at least one formwork element or beam and the additional formwork panel element form an L-configuration or a reverse L-configuration.

In one example, the relative motion comprises simultaneous motion in a horizontal direction and a vertical direction.

Another aspect of the disclosure provides a method of striking a formwork element or a beam from poured concrete, comprising: engaging a striking element of a striking tool with the formwork element or the beam; attaching a base element of the striking tool with a mounting surface of the poured concrete; actuating an actuation mechanism of the striking element causing relative movement of the striking element relative to the base element, wherein a parallelogram configuration defined by the base element, the striking element and a plurality of struts of the striking tool is maintained during actuation; and striking the formwork element or the beam from the poured concrete.

In one example, the relative motion comprises simultaneous motion in a horizontal direction and a vertical direction.

The present application advantageously allows for stripping (e.g., striking) of formwork from poured concrete that eliminates risk of damage to the poured concrete and also risks of jobsite workers and their personal effects.

BRIEF DESCRIPTION OF THE DRAWINGS

The invention description below refers to the accompanying drawings, of which.

DETAILED DESCRIPTION

Figure 1A:
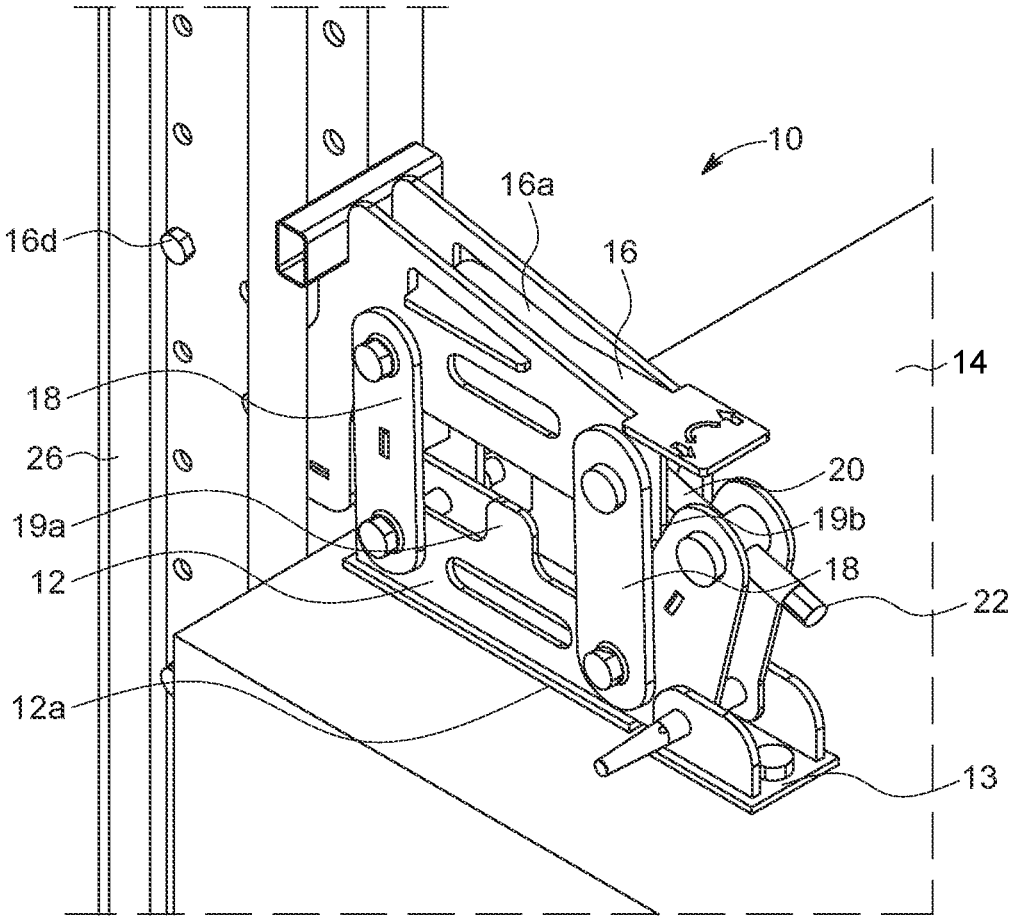
FIG. 1A is a perspective view of a striking tool according to one or more aspects of the disclosure.
Figure 1B:
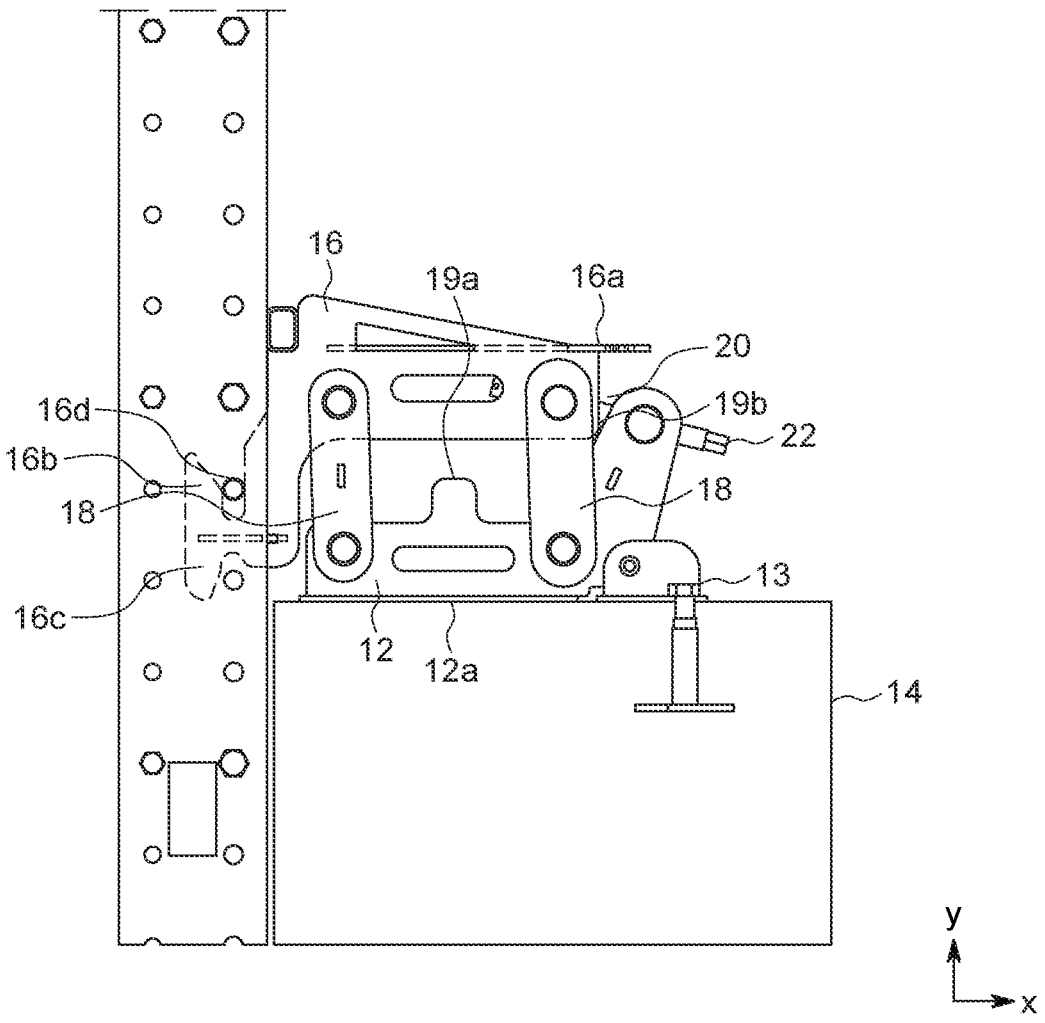
FIG. 1B is a side view of the striking tool of FIG. 1A according to one or more aspects of the disclosure

FIG. 1A is a perspective view of a striking tool 10 and FIG. 1B is a side view of the striking tool of FIG. 1A according to one or more aspects of the disclosure.

As shown in FIGS. 1A-B, the striking tool 10 can include at least a base element 12 configured to engage with a mounting surface 14 via mounting portion 13. The base element 12 can be formed of any type of material, such as steel, aluminum, or the like. A bottom surface 12*a* of the base element 12 facing the mounting surface 14 can have a rectangular profile, or in other examples can have polygonal-shaped profiles.

The base element 12 can be attached, releasably, semi-permanently, or permanently to mounting surface 14 by inserting a screw, bolt, or other type of fixation element into the mounting portion 13. In this regard, the mounting portion 13 can define a through-hole for receiving the screw, bolt, or other fixation element.

In this example, the mounting surface 14 is a surface of poured concrete, such as a bridge head or bridge pier (as will be explained in detail below with respect to FIGS. 3A-B). While the mounting surface 14 is depicted as planar or substantially planar, it is contemplated that the mounting surface can have an uneven or irregular surface, provided that at least a portion is planar in such a manner that base element 12 can be fixed to the planar portion of the mounting surface 14.

The striking tool 10 can also include at least a striking element 16 configured to engage with the base element 12 via one or more struts 18 and configured to engage directly or indirectly with a portion of a formwork element (such as a formwork panel) or a beam 26 that can be connected to the formwork element (such as the formwork panel).

The striking element 16 can be formed of any type of material, such as steel, aluminum, or the like. A top surface 16*a* of the striking element 16 facing away from the mounting surface 14 can have a rectangular profile, or in other examples can have polygonal-shaped profiles.

The striking element 16 can be releasably engaged with the beam 26 (or a formwork element such as a formwork panel) by one or more connection elements 16*b, c* (shown in phantom in FIG. 1B). The connection elements 16*b, c* are integrally formed with the striking element 16 can define one or more recesses to engage with one or more bolt connections 16*d* to ensure a secure engagement between beam 26 (or a formwork element such as a formwork panel) and striking tool 10. As depicted in FIG. 1A, the striking element 16 can be indirectly engaged with the base element 12 by way of one or more struts 18. The struts 18 are depicted in FIG. 1A as having a stadium-shape, e.g., a two-dimensional geometric shape constructed of a rectangle with semicircles at a pair of opposite sides. In other examples, the struts 18 can have other 2D shapes, such as ovular, ellipsoid, or any other shape generally having a longitudinal axis. The base element 12, the striking element 16, and the struts 18 generally define a parallelogram configuration that is maintained in both the actuated and unactuated states.

In general, the y direction defines a vertical axis and x defines a horizontal or longitudinal axis. In the configuration of FIG. 1B, the struts 18 are parallel to one another and lie generally parallel (or almost parallel) to the vertical y axis. In one example, the top surface 16*a* and the bottom surface 12*a* can be parallel or essentially parallel to each other and can each be perpendicular to the vertical y axis. In other examples, a relative desired angle can exist between the surfaces 12*a* and 16*a* in an unactuated state.

The struts 18 can define one or more through-holes for receiving a screw, bolt, or other fixation element for hingedly securing the strut 18 respectively to each of the base element 12 and the striking element 16. In other examples, the strut 18 can be integrally formed with either or both of the base element 12 and the striking element 16. Movement of the struts 18, and ultimately the striking element 16, can be limited by an area or portion of the striking tool itself, for example a first stopper element 19*a* and a second stopper element 19*b*. In one example, the first stopper element 19*a* and/or the second stopper element 19*b* are integrally formed with the striking tool 10. For example, second stopper element 19*b* can prevent the struts 18 from moving beyond the unactuated state during transition from the actuated to unactuated state. The first stopper 19*a* can prevent the struts 18 from moving beyond the actuated state during transition from the unactuated to actuated state.

Stated another way, movement from the unactuated state to the actuated state can be limited or stopped when a lower surface of the striking element 16 confronts the stopper element 19*a*. Once confronted, the striking tool cannot be actuated further. Movement from the actuated state to the unactuated state can be limited or stopped when a side portion of the striking element 16 confronts the stopper element 19*b*. Once confronted, the striking tool cannot be unactuated further beyond the rectangle created by struts 18.

The striking tool 10 can also include an actuation mechanism 20. In one example, the actuation mechanism can be a spindle, e.g., cylindrical or substantially cylindrical. The actuation mechanism 20 can be formed of any type of material, such as steel, aluminum, or the like. The actuation mechanism 20 can be engaged with an interior portion of the striking element 16 in such a manner that rotation of the spindle, e.g., by way of attachment point 22, can cause motion of the striking element 16 with respect to the base element 12. For example, the motion of the striking element 16 can include simultaneous motion in the horizontal (e.g., lateral or side-to-side) and vertical (upward or downward) directions by virtue of the rotational motion of the respective struts 18 about their pivot points relative to base 12. The attachment point 22 can be configured for attachment by a tool, such as a ratchet, wrench, or other tool.

Figure 2A:
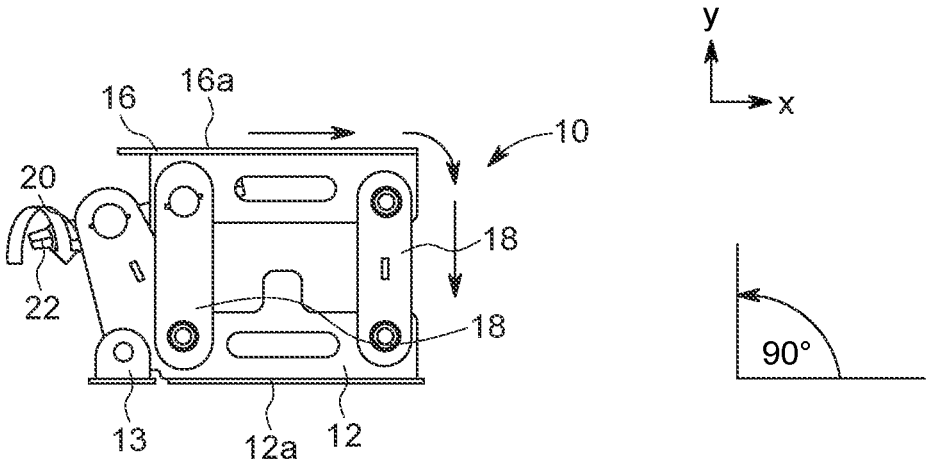
FIG. 2A is a side view of a striking tool in an unactuated state.
Figure 2B:
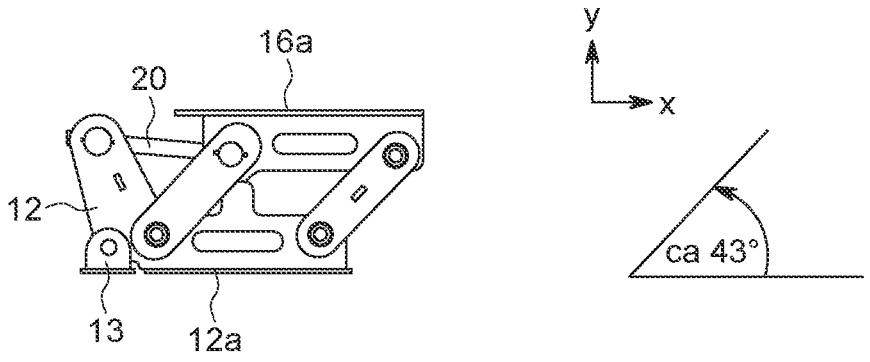
FIG. 2B is a side view of a striking tool in an actuated state.

FIGS. 2A-B are side views of the striking tool in a simplified view illustrating function of the actuation mechanism 20. In FIG. 2A, the actuation mechanism 20 is in a first state, e.g., unactuated state, in which the struts 18 are substantially perpendicular with respect to a longitudinal axis of base element 12 and/or to a longitudinal axis of striking element 16. In the first unactuated state, longitudinal axes of the respective struts 18 remain parallel with one another and the parallelogram configuration of base element 12, striking element 16, and struts 18 is maintained. In another example, the parallelogram configuration can be defined by the longitudinal axes of the struts 18 and the horizontal axis x.

Upon actuation of the actuation mechanism 20, e.g., by way of turning the spindle in a direction of arrow in FIG. 2A, the striking element 16 moves laterally and downward simultaneously in by virtue of the engagement with struts 18. As shown in FIG. 2B, the struts 18 rotate about the engagement point with the base element 12. While doing so, the struts 18 retain their parallel relationship with one another and the parallelogram configuration of base element 12, striking element 16, and struts 18 is maintained. Also during rotation and in one example, the top surface 16*a* of striking element 16 and a bottom surface 12*a* of base element 12 also retain their parallel relationship with one another. These parallel relationships and parallelogram configuration are maintained during all states of actuation or unactuation. In another example, the struts 18 retain their parallel relationship during rotation and the top surface 16*a* and bottom surface 12*a* retain the desired angle during rotation, with the struts 18 and the horizontal axis x cooperatively defining and maintaining a parallelogram configuration in the actuated and unactuated states, as well as all points in between.

In the unactuated state of FIG. 2A, the struts 18 can be disposed along the vertical axis y such that the struts 18 can form a substantially 90 degree angle relative to the horizontal axis. In some examples, the struts 18 can be disposed at an angle just below 90 degrees relative to the horizontal axis in the unactuated state. For example, the angle can be less than about 90 degrees, and in one example can be about 87 degrees. In this regard, movement beyond a position between the 87 degree and 90 degree positions can be prevented by stopper element 19*b* or any other type of mechanical restriction. An angle of less than about 90° (for example 87°) has an the advantage that horizontal motion occurs immediately upon actuation, whereas at a 90 degree angle appreciable horizontal motion may not immediately occur. Thus, simultaneous horizontal and vertical motion can be realized.

In another example, such as with custom or specially-shaped bridge pier heads, the struts 18 may be in a position of 135 degrees in an unactuated state and rotation beyond this may be limited by the stopper element 19*b*. This may be advantageous in situations where more offset in the vertical direction than horizontal direction is desirable for striking, such as specially shaped bridge pier heads that are not rectangular.

As shown in FIG. 2B, the striking tool 10 is in the actuated state. In this example, the struts 18 can form an about 43 degree angle relative to the horizontal axis. Further actuation can be restricted by a stopper element 19*a*.

When the striking element 16 moves laterally and downward by virtue of the engagement with struts 18, this exerts a corresponding lateral and downward force on the attached formwork element or beam (e.g., beams 26*a, b*) that is engaged with the striking element. This lateral and downward force results in the beams 26*a, b* being removed from the cured concrete.

Figure 3A:
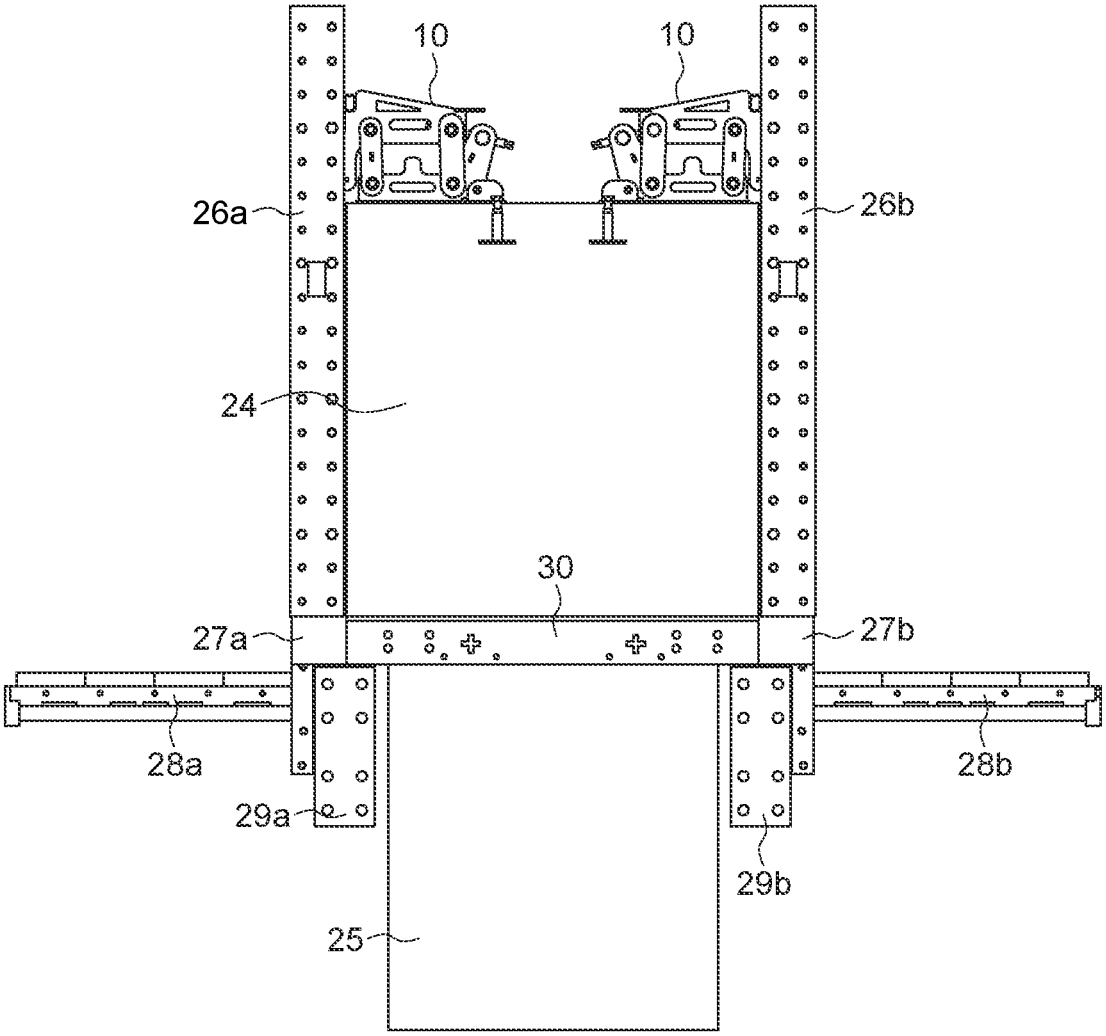
FIG. 3A shows a bridge head with attached striking tool in an unactuated state.
Figure 3B:
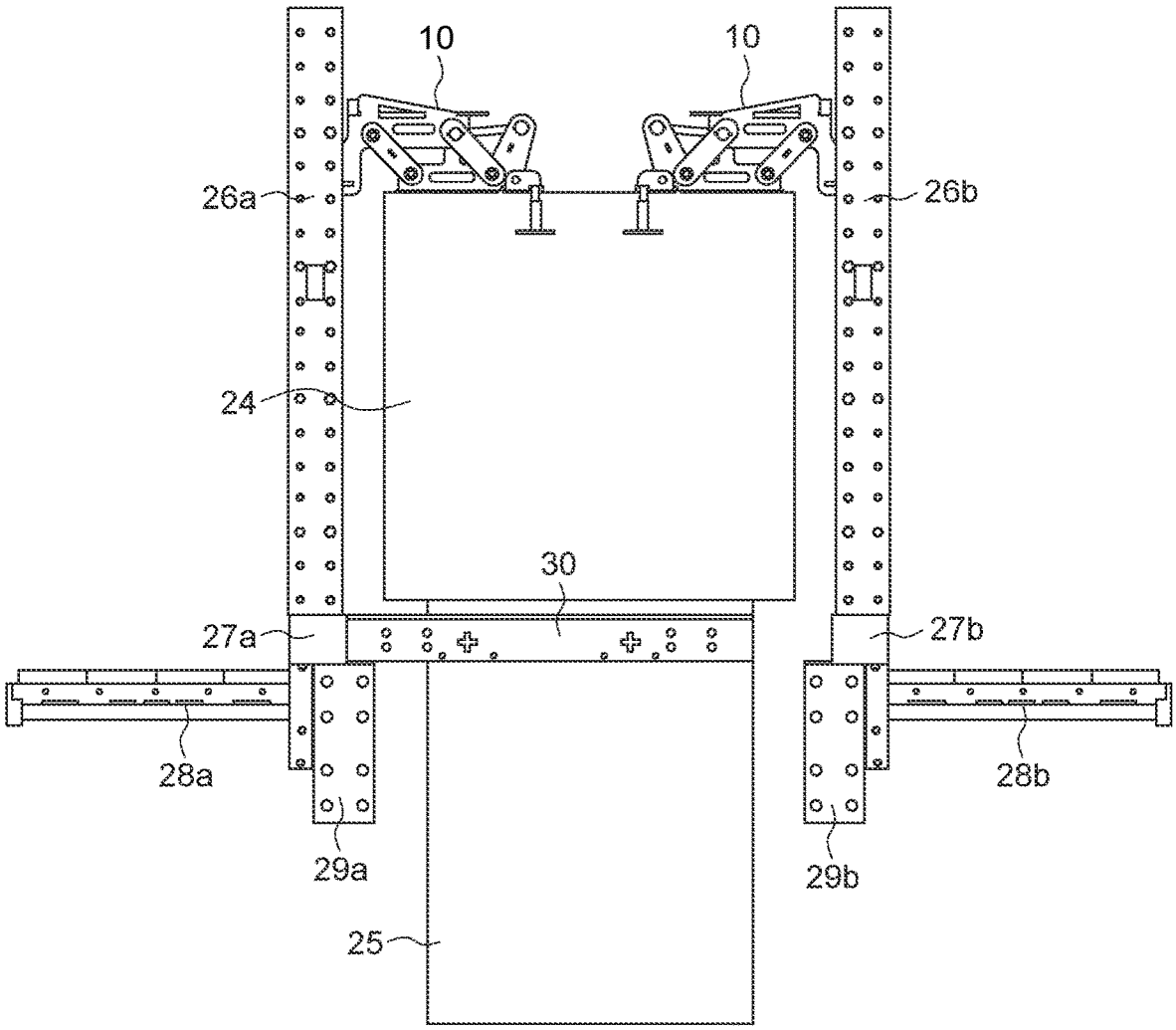
FIG. 3B shows a bridge head with attached striking tool in an actuated state.

FIGS. 3A-B depict a bridge head with attached striking tool in an unactuated and actuated state, respectively. In this example, a bridge head 24 has been formed on a bridge pier 25, for example on a worksite. Two striking tools 10 have been installed on a top surface of the bridge head 24 and are engaged with respective beams 26*a, b* (either directly or indirectly by an intermediate vertical bar) in order to strip the respective beams 26*a, b* from the bridge head 24. In other examples, the striking tools 10 can be engaged directly or indirectly to a formwork element, such as a formwork panel.

Each of the beams 26*a, b* can support a respective working platform 28*a, b*, and a horizontal formwork element 30 can be attached to one of the formwork panels 26. In the example of FIGS. 3A-B, the horizontal formwork element 30 is attached to the left-hand beam 26*a*, forming an L-shaped arranged by virtue of the combination of beam 26*a* and horizontal formwork element 30.

The respective working platforms 28*a, b* are attached to the respective beams 26*a, b* by respective connection beams 27*a, b*, with respective main beams 29*a, b* attached to and supporting the respective connection beams 27*a, b*. In this regard, as depicted in FIG. 3B, the left-hand beam 26*a*, left-hand connection beam 27*a*, left-hand working platform 28*a*, left-hand main beam 29*a*, and horizontal formwork element 30 can be moved as a single unit. In other examples, the working platform 28*a* can be removed individually and separately while still maintaining the L-shape configuration formed by the beam 26*a* and horizontal formwork element 30.

In FIG. 3A, beams 26*a, b* confront the bridge head 24 by virtue of the pouring and concreting process in forming the bridge head 24. Upon actuation of the striking tools 10, the beams 26*a, b* are moved simultaneously horizontally and vertically (e.g., downward) with respect to bridge head 24 in a controlled manner by virtue of operation of the striking tool 10 described above. In the left-hand assembly, the single unit of elements 26*a*, 27*a*, 28*a*, 29*a*, and 30 can be moved as a single unit, while in the right-hand assembly 26*b*, 27*b*, 28*b* and 29*b* move as a single unit. The horizontal formwork element 30, e.g., a soffit panel, is disposed beneath a bottom surface of bridge head 24 in support of the pouring and concreting and thus cannot be moved upwards. It also cannot easily be moved in a pure horizontal manner due to the confronting and supporting relationship of horizontal formwork element 30 and bridge head 24. In this regard, the combined lateral and downward movement provided by the striking tool 10 allows for stripping (e.g., striking) of the horizontal formwork element 30 from the bridge head 24 in a manner that does not compromise the bridge head 24.

While the two striking tools 10 of FIGS. 3A-B are depicted as being operated substantially simultaneously or simultaneously to strike the beam 26*a, b* from the bridge head 24, it is contemplated that the striking tools 10 can be operated separately and independently and offset by a predetermined or arbitrary time.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. Accordingly, this description is meant to be taken only by way of example, and not to otherwise limit the scope of this invention.

What is claimed is:

1. A striking tool, comprising:

a base element;

a striking element comprising one or more connection elements defining one or more recesses, the connection elements being configured to engage with at least one of a formwork element or a beam;

a plurality of struts, wherein the base element, the striking element, and the plurality of struts define a parallelogram configuration; and an actuation mechanism comprising a threaded spindle configured to cause lateral motion of the striking element relative to the base element, such that motion of the striking element includes simultaneous motion in horizontal and downward directions, wherein when activating the actuation mechanism the parallelogram configuration defined by the base element, the striking element, and the plurality of struts is maintained.

2. The striking tool of claim 1, wherein the base element comprises a mounting portion configured to attach the base element to a mounting surface.

3. The striking tool of claim 1, wherein the spindle comprises an attachment point configured to receive a screw-wrench or ratchet.

4. The striking tool of claim 1, further comprising a first stopper element and a second stopper element each configured to limit movement of the striking element relative to the base element.

5. The striking tool of claim 4, wherein the second stopper element limits the movement beyond a rectangle form of the parallelogram configuration.

6. The striking tool of claim 4, wherein the second stopper element limits the movement of the struts to a maximum angle of 90 degrees or less in the unactuated state.

7. The striking tool of claim 4, wherein the first stopper element and the second stopper element are integrally formed with the striking tool.

8. The striking tool of claim 2, wherein the mounting portion defines a through-hole configured to receive a screw or bolt for attaching the base element to the mounting surface.

9. The striking tool of claim 1, wherein the relative motion comprises simultaneous motion in a horizontal direction and a vertical direction.

10. The striking tool of claim 1, wherein the formwork element comprises a formwork panel.

11. The striking tool of claim 1, wherein the one or more connection elements are at a position below a top surface of the striking element.

12. The striking tool of claim 1, wherein the simultaneous motion in horizontal and downward directions is by virtue of rotational motion of respective struts about their pivot points relative to the base element.

13. The striking tool of claim 1, wherein the one or more recesses engage with one or more bolt connections to secure engagement with the at least one of the formwork element or the beam.

14. The striking tool of claim 1, wherein the actuation mechanism is engaged with an interior portion of the striking element.

15. A concrete formwork system for a bridge or bridge pier head, the system comprising:

at least one of a formwork element or a beam; and at least one striking tool engaged with the at least one of the formwork element or the beam, the at least one striking stool comprising:

a base element;

a striking element configured to engage with the at least one formwork element or the beam;

a plurality of struts, wherein the base element, the striking element, and the plurality of struts define a parallelogram configuration; and an actuation mechanism configured to cause relative motion between the base element and the striking element, wherein the relative motion comprises simultaneous motion in a horizontal direction and a vertical direction.

16. The system of claim 15, wherein the at least one formwork element or beam has a longitudinal axis that is substantially perpendicular to a bottom surface of the base element when the at least one formwork element or beam is engaged with the striking element of the striking tool.

17. The system of claim 15, further comprising a formwork panel such that the at least one formwork element or beam and the formwork panel element form an L-configuration or a reverse L-configuration.

18. A method of striking a formwork element or a beam from poured concrete, comprising:

engaging a striking element of a striking tool with the formwork element or the beam;

attaching a base element of the striking tool with a mounting surface of the poured concrete;

actuating an actuation mechanism of the striking element causing relative movement of the striking element relative to the base element, wherein a parallelogram configuration defined by the base element, the striking element and a plurality of struts of the striking tool is maintained during actuation; and striking the formwork element or the beam from the poured concrete.

19. The method of claim 18, wherein the relative motion comprises simultaneous motion in a horizontal direction and a vertical direction.

* * * * *